US005349902A

United States Patent [19]

Daniel et al.

[11] Patent Number: 5,349,902

[45] Date of Patent: Sep. 27, 1994

[54] PRESS SHUTHEIGHT ADJUSTMENT MECHANISM

[75] Inventors: Edward A. Daniel, Fort Loramie; Frederick C. Bergman, Coldwater, both of Ohio

[73] Assignee: The Minster Machine Company, Minster, Ohio

[21] Appl. No.: 49,991

[22] Filed: Apr. 20, 1993

[51] Int. Cl.[5] ..... B30B 15/14; B30B 1/26

[52] U.S. Cl. ..... 100/48; 72/21; 72/446; 74/583; 74/586; 83/530; 100/53; 100/257

[58] Field of Search ..... 100/43, 48, 53, 257, 100/282, 299; 72/21, 446, 448, 455; 83/527, 530; 74/583, 586

[56] References Cited

U.S. PATENT DOCUMENTS

| | | | |
|---|---|---|---|
| 2,784,665 | 3/1957 | Georgeff | 100/282 X |
| 3,178,983 | 4/1965 | Brunson | 83/530 |
| 3,858,432 | 1/1975 | Voorhees et al. | 100/257 X |
| 3,892,143 | 7/1975 | Kleister et al. | 100/257 X |
| 4,011,809 | 3/1977 | Waller et al. | 100/257 X |
| 4,030,336 | 6/1977 | Grigorenko et al. | 72/432 |
| 4,095,522 | 6/1978 | Drungil | 100/257 X |
| 4,150,618 | 4/1979 | Spanke et al. | 100/257 |
| 4,166,415 | 9/1979 | Spanke et al. | 100/257 X |
| 4,206,699 | 6/1980 | Hemmelgarn | 100/53 |
| 4,206,701 | 6/1980 | Hemmelgarn | 100/257 |
| 4,289,066 | 9/1981 | Proga | 100/53 |
| 4,375,785 | 3/1983 | Schoch et al. | 100/282 X |
| 4,464,916 | 8/1984 | Grew et al. | 72/17 |
| 4,785,732 | 11/1988 | Czapka et al. | 100/257 |
| 4,790,173 | 12/1988 | Boutcher, Jr. | 72/446 |
| 4,918,956 | 4/1990 | Schoch | 72/21 |
| 5,109,766 | 5/1992 | Ontrop et al. | 100/282 X |
| 5,123,342 | 6/1992 | Camossi | 100/299 X |

FOREIGN PATENT DOCUMENTS

| | | | |
|---|---|---|---|
| 614154 | 6/1935 | Fed. Rep. of Germany | 100/282 |
| 657540 | 3/1938 | Fed. Rep. of Germany | 100/53 |
| 60-40700 | 3/1985 | Japan | 100/53 |
| 4-162998 | 6/1992 | Japan | 100/257 |
| 4-262900 | 9/1992 | Japan | 100/53 |
| 629082 | 10/1978 | U.S.S.R. | 100/257 |

*Primary Examiner*—Stephen F. Gerrity
*Attorney, Agent, or Firm*—Baker & Daniels

[57] ABSTRACT

A shutheight adjustment mechanism of a press including a male threaded member threadedly engaged to a female threaded member with a clearance space therebetween is flooded with a liquid to reduce undamped free movement between the threaded members. Liquid injected in the clearance space causes a squeeze-film to be created, capable of supporting high impulse working loads. Seals define the clearance space to assure that the entire clearance space is filled with liquid. In one embodiment, the shutheight adjustment mechanism is included in the press slide.

18 Claims, 5 Drawing Sheets

PRESS SHUTHEIGHT ADJUSTMENT MECHANISM

BACKGROUND OF THE INVENTION

The present invention relates generally to mechanical presses and in particular to a shutheight adjustment mechanism, wherein punching and snapthrough loads through the shutheight adjustment mechanisms are more accurately controlled.

Mechanical presses, for example, stamping presses and drawing presses, comprise a frame having a crown and bed and a slide supported within the frame for motion toward and away from the bed. The slide is driven by a crankshaft having a connecting arm connected to the slide. Such mechanical presses are widely used for stamping and drawing operations and vary substantially in size and available tonnage depending upon the intended use.

In prior art presses of this type, the slide is generally connected to the crankshaft by a connecting rod which is adjustable in length or which is connected to another member, such as a connection screw, that is adjustable in its relation to the slide so that the shutheight opening between the slide and the bed can be adjusted to accommodate various die sets. Alternatively, the bed portion or bolster of the press may have its position adjusted relative to the slide so as to adjust the shutheight therebetween, as disclosed in U.S. Pat. No. 3,858,432. Regardless of the mode of shutheight adjustment, the slide is generally guided on the uprights of the press frame extending between the crown and the bed so that the parts of the die set remain in accurate registration as the slide reciprocates.

Many prior art mechanical presses include a plurality of connection screw assemblies for reciprocating the slide and it is customary practice to provide a shutheight adjustment mechanism whereby the position of the slide relative to each of the connection screws adjusted simultaneously by means of an interconnected worm and worm gear arrangement, which is driven either manually or by means of an operator controlled motor.

Prior problems with shutheight adjustment mechanisms include the transfer of punching and snapthrough loads through the adjustment mechanisms during press operation. A press load is the load created by the mechanical press when the slide is urging its associated die into contact with the work piece. When the work piece fractures in the die, the slide attempts to rapidly accelerate downward i.e. snapthrough. This snapthrough load is comprised mainly of this downward acceleration and the downward slider crank inertial acceleration of the die and slide combination. These loads, if not compensated for, cause changes in shutheight.

A particular problem for accurately controlling press shutheight is the tolerances between the connected portions of the press, and specifically the connections of the shutheight adjustment mechanism to the slide or bolster. Shutheight adjustment mechanisms require certain clearances between the parts during the manufacture, assembly, and adjustment so that the worm gear, adjustment nuts, and connection screws may turn and move so that they may operate. These same clearances between the parts cause a problem during press use, since the clearances increase the possible ranges of shutheight during press operation.

The clearances also prevent the even transmission of pressure loads through the press. This uneven transmission of forces may cause particular parts, undergoing concentrated impact forces, to fail. Again, the clearances between the parts permit the shutheight to variably change during operation of the press resulting in workpieces that may not meet design specifications.

The present invention is directed to overcome the aforementioned problems associated with mechanical press shutheight adjustment mechanisms wherein it is desired to accurately control shutheight while increasing protection of the shutheight adjustment mechanisms.

SUMMARY OF THE INVENTION

The present invention provides a shutheight adjustment mechanism including an assembly for injecting a liquid within the clearance spaces so that undamped, free movement between the adjustment mechanism parts is reduced. This is accomplished by flooding oil into the adjustment mechanism and then trapping oil within the mechanism such that all of the clearance spaces are filled. When the adjustment mechanism is subjected to the press punching, forming, snapthrough, and inertia loads, the oil becomes squeezed within the clearances. The trapped oil supports those loads on a pressure film (a "squeeze-film"), thereby reducing part movement and impact loads.

The injected oil reduces the torque necessary to operate the shutheight mechanism thereby making it easier to adjust shutheight. Furthermore, the oil film created also lies on the threads of the threaded parts thereby protecting the threaded areas from impact forces. The oil film also lies on other portions of the adjustment mechanism and provides the same protection from impact and corrosion.

The shutheight adjustment mechanism is permitted to operate while the press is cycling. This is termed adjust-in-motion.

An advantage of the shutheight adjustment mechanism of the present invention is that the oil filled clearances eliminate undamped free movement between parts, helping to resist changes in dynamic shutheight. This resistance to changes in shutheight permit the press to create workpieces with smaller tolerances.

Another advantage of the shutheight mechanism of the present invention, in accordance with one form thereof, is that the injected oil helps control punching and snapthrough loads through the press and bolster adjustment mechanisms. This levels dynamic loads over the entire adjustment mechanism thereby reducing part failure rates caused by unequal impulse forces.

Yet another advantage of the shutheight mechanism of the present invention is that the trapped oil helps reduce punch penetration resulting in a dynamically stiffer press die set thereby correspondingly increasing die life. By more accurately controlling shutheight, accidental impacts between the dies are reduced.

A still further advantage of the shutheight mechanism is that the oil squeeze film created supports high impulse press working loads including short time duration, high magnitude punching and snapthrough loads. By filling the clearance spaces within the adjustment mechanism, the oil film carries the short duration impulse loads on engaging screw threads and other portions of the adjustment mechanism. A sufficient surface area is permitted to carry the expected loads of the press.

The invention, in one form thereof, provides a press with a frame structure having a crown and bed with a slide guides by the frame structure for reciprocating in opposition to the bed. A bolster assembly is mounted to the bed of the press. A shutheight adjustment mechanism is attached to the press to adjust the shutheight between the slide and the bolster. The mechanism has a male threaded member threadably engaging a female threaded member having a clearance space therebetween. An injection means to inject a liquid within the clearance spaces is provided so the liquid may reduce undamped free movement between the threaded members and other adjustment parts.

In one form of the invention, the shutheight adjustment mechanism includes a feedback means to measure the shutheight and automatically change the shutheight to a predetermined shutheight.

In another form of the invention, a press includes a frame having a crown and bed with a slide guided by the frame for reciprocating movement in an opposed relation to the bed. A drive means is attached to the frame structure for reciprocating the slide while a bolster assembly is mounted to the bed. A shutheight adjustment mechanism is attached to the slide in which a male threaded member has a female threaded member threadably engaged upon. Alternatively, the adjustment mechanism may be mounted to the bolster. The male member is connected to either the drive means or the slide with the female member connected to the other of the drive means and the slide. A measuring means is included to measure the shutheight of the press while an adjustment drive means used to rotate one of the male and female members relative the other to change the shutheight. A control means is used to compare the measured shutheight to a desired shutheight and control actuation of the adjustment drive means. A means is included to inject liquid within a clearance space between the adjustment drive means and male and female threaded members which reduces undamped free movement between the adjustment nut, and between the male and female threaded members.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
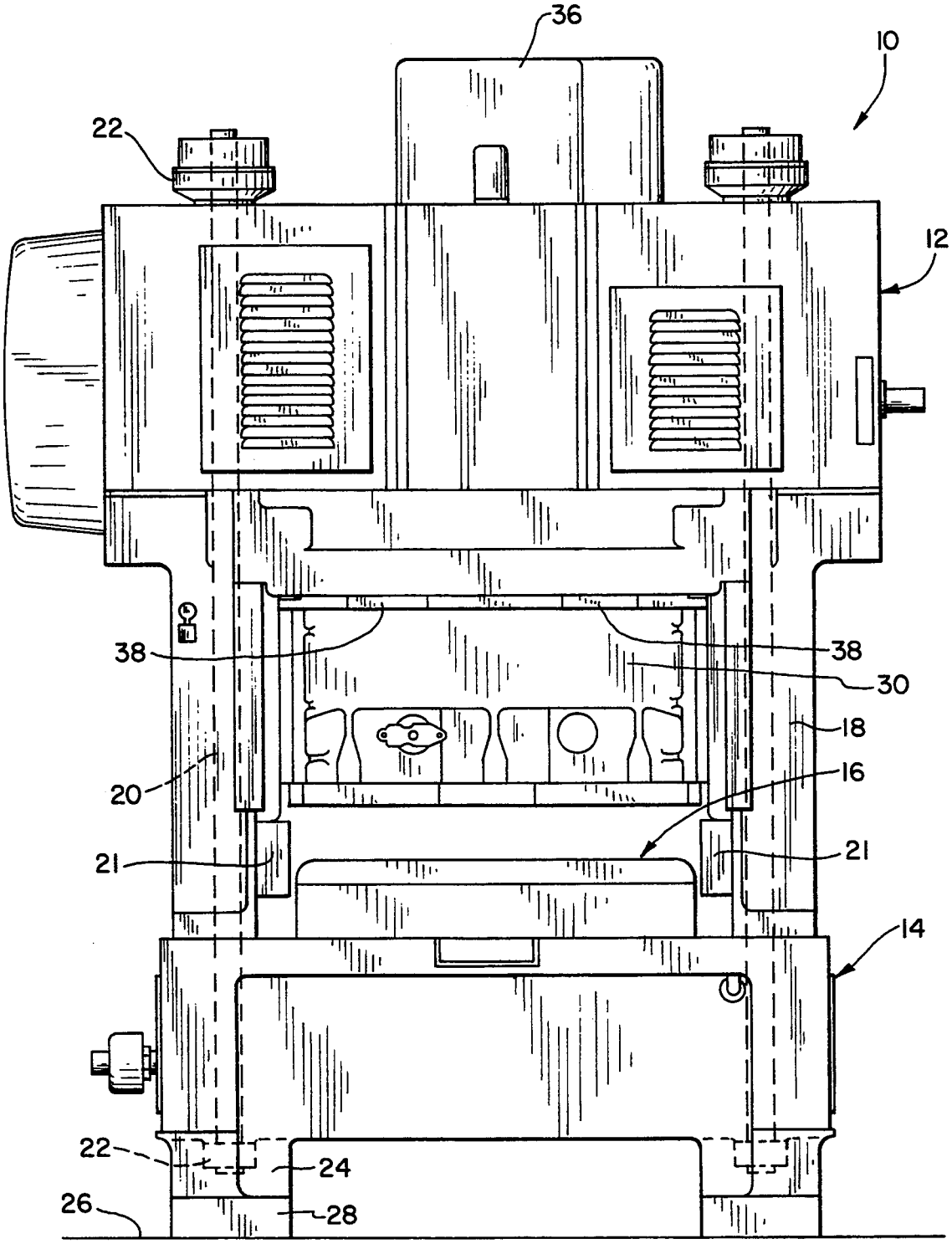
FIG. 1 is a front elevational view of a mechanical press incorporating the shutheight adjustment mechanism of the present invention.

Referring now to FIG. 1, mechanical press 10 comprises a crown portion 12, a bed portion 14 having a bolster assembly 16 connected thereto and uprights 18 connecting crown portion 12 with bed portion 14. Uprights 18 are connected to or integral with the underside of crown 12 and the upper side of bed 14. Tie rods 20 extend through crown 12, uprights 18 and bed portion 14 and are attached one each end with tie rod nuts 22. Leg members 24 are formed as an extension of bed 14 and are generally mounted on the shop floor 26 by means of shock absorbing pads 28.

Press shutheight is controlled by first measuring the shutheight between slide 30 and bolster 16 by a shutheight measuring means 21 such as a limit switch, an accelerometer or a non-contacting optical or electrical sensing means as is known in the art. The shutheight adjustment mechanism is then activated to change the measuring shutheight to a desired shutheight. The present invention is directed to improve current shutheight adjustment mechanisms thereby permitting more accurate shutheight adjustment while the press 10 is cycling.

The present invention comprises creating oil squeeze-film protection along threaded members and parts that make contact during press cycling. Although oil is the preferred liquid used to protect the shutheight adjustment mechanism, other hydraulic fluids may be used.

Creation of an oil squeeze film layer is caused by flooding the adjustment mechanism with lubrication oil and then trapping this oil within the mechanism so that all or substantially all of the clearance spaces are filled. Although the invention operates best when all of the clearance spaces are filled, the invention may operate when only some of the clearance spaces are filled with liquid.

Figure 4:
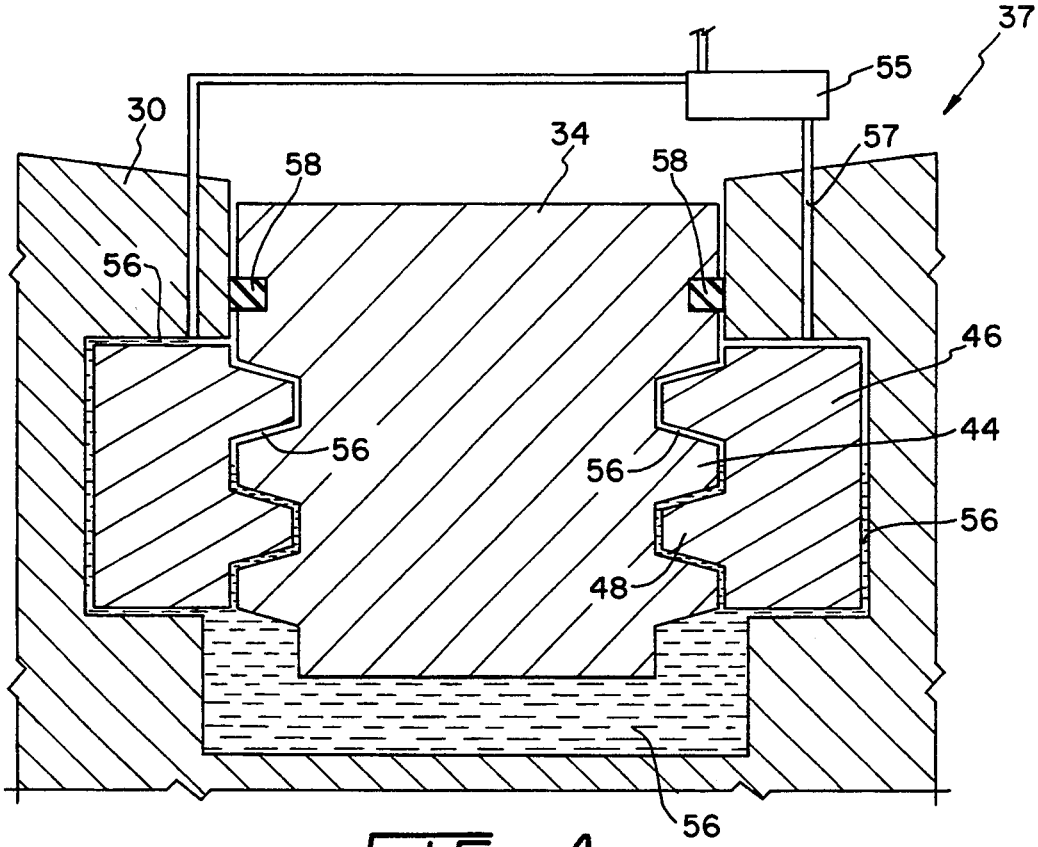
FIG. 4 is an exaggerated fragmentary sectional view of a connection screw before oil is injected within the clearance spaces.

FIG. 4 illustrates this concept showing a connection screw 34 having threads 44 intermeshed with threads 48 of adjustment nut 46. A clearance space 56 is shown between connection screw 34 and adjustment nut 46 along with clearance space 56 between adjustment nut 46 and in this particular embodiment slide 30. Note that these clearances 56 must be present to allow for manufacture, assembly, and adjustment of the parts. Thread clearances on the top and bottom surfaces of the adjustment nut 46 and clearances on the outer diameters of the adjustment nut 46 and screw 34 are all necessary.

The injection means of the present invention such as pump 55 is used to inject oil into clearance space 56. Pump 55 is operably connected to an oil supply (not shown) and connected to clearance space 56 by oil passageway 57. Seals 58 seal clearance space 56 to prevent exit of any fluids from clearance space 56 and prevent entry of dirt and debris into the spaces around adjustment nut 46. These seals 58 are located in the shutheight adjustment mechanism or may be located outside of the mechanism if the entire mechanism is flooded with liquid.

Figure 5:
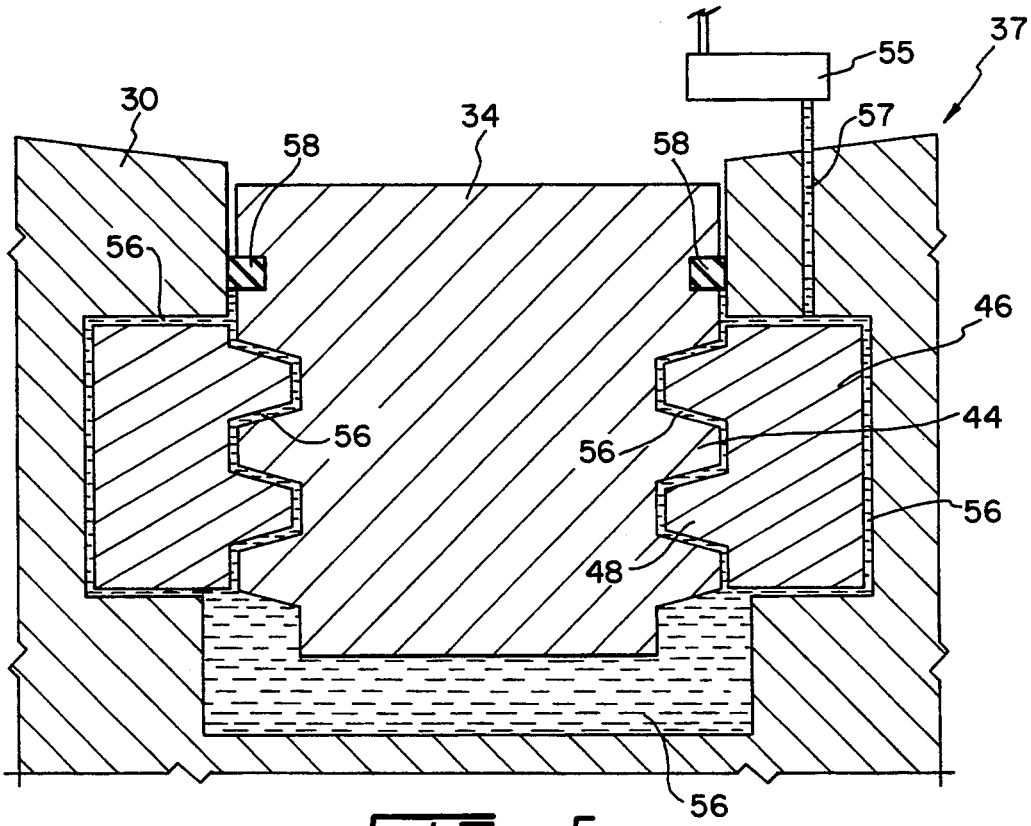
FIG. 5 is an exaggerated fragmentary sectional view of a connection screw shown with oil filling all the clearance spaces.

FIG. 5 shows clearance space 56 filled with a pressurized or non-pressurized liquid such as lubricating oil. For purposes of this application, non-pressurized oil is defined to mean oil that is at atmospheric pressure. An example would be oil sitting in an open drum exposed to the atmosphere. Pressurized oil is defined to mean oil at pressures greater than atmospheric pressure.

Another possible way of filling clearance space 56 is with recirculating oil. Oil is caused to flow into clearance space 56 and after use, caused to flow out of clearance space 56. This flow of oil allows heat generated with the mechanism to be transported away. It is important to note that care has to be taken during application of press loads to prohibit an excess of oil to escape from clearance space 56, thereby preventing the oil pressure film from developing. When oil is trapped within clearance space 56 and a press load applied, an oil squeeze film is developed between screws 34, adjustment nut 46, in between threads 44 and 48. An oil film also is created between adjustment nut 46 and slide 30.

When the fragment of the shutheight adjustment mechanism depicted (FIG. 5) is subjected to a vertical press load such as a punching or snapthrough load or slide inertial force, the oil becomes squeezed within clearance space 56. Because the oil has no where to flow or extremely little time to flow out of clearance space 56, a pressure film develops, thus transmitting the load through the adjustment mechanism without high velocity impact between the screw 34 or nut 46. This oil squeeze-film effect reduces the free vertical movement of the adjustment parts resulting in a dynamically stiffer mechanism that reduces punch penetration and subsequential die wear.

The oil squeeze film effect is dependent on many different factors, all determined from the specific press structure and press operating requirements. A minimum oil film thickness of approximately 0.0001 inches has been found to give the best results. Smaller oil films tend to allow detrimental contact between parts causing an increase in wear.

The resulting shutheight mechanism of the present invention may be utilized in the slide 30 mechanism or bolster assembly 16 of mechanical press 10.

Figure 2:
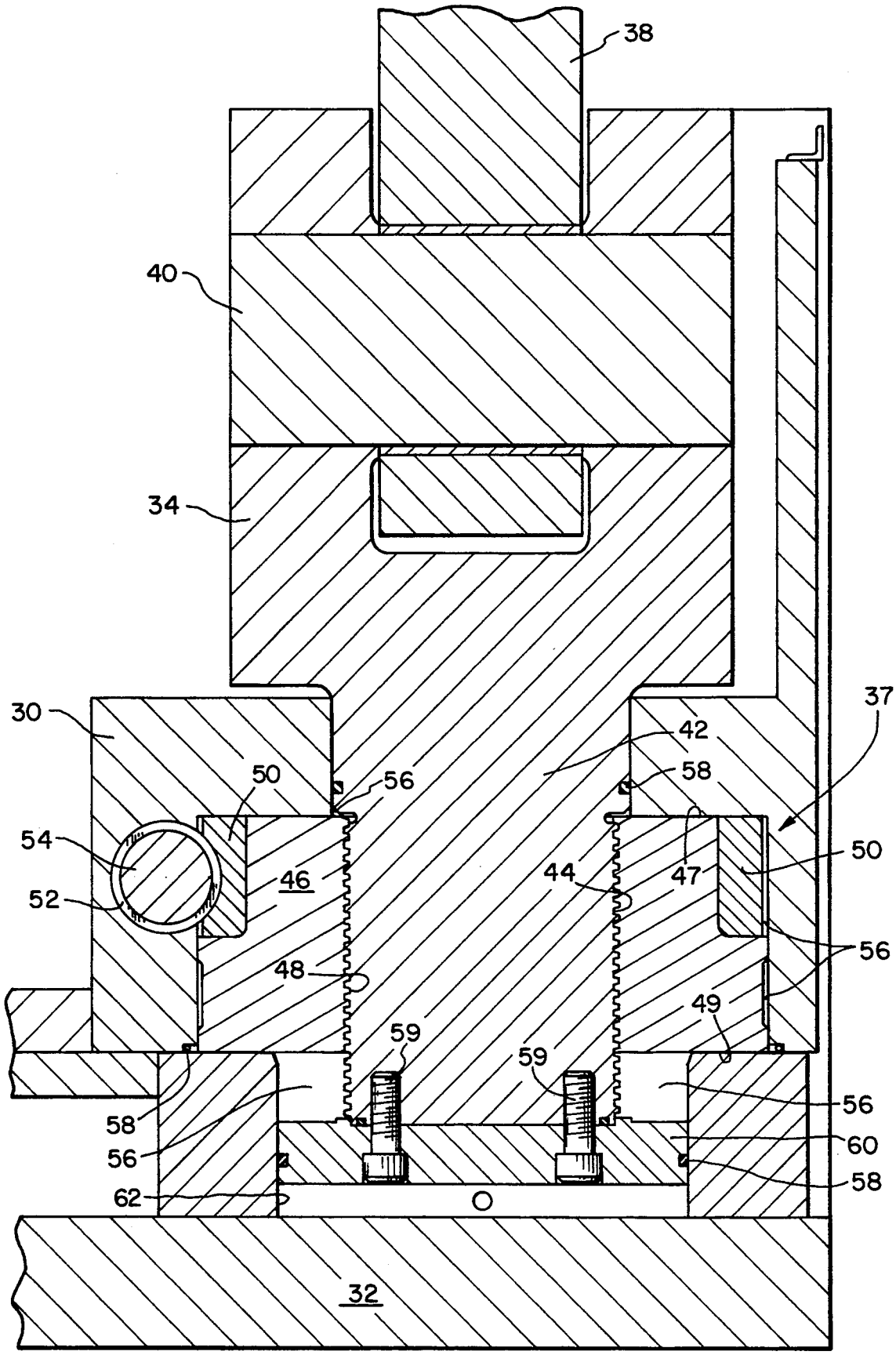
FIG. 2 is an enlarged fragmentary sectional view of the shutheight adjustment mechanism for one of the connection screws shown in FIG. 1.

One embodiment shown in FIG. 2 depicts a slide 30 having a slide bottom plate 32 attached as by bolting to slide main member 30. Slide 30 is connected to a plurality of connection screws 34 for vertical reciprocating movement within crown portion 12. The drive mechanism of the press is comprised of a crankshaft driven through a conventional clutch arrangement (not shown) by motor 36. In order to simplify description, only the attachment of one slide shutheight adjustment mechanism will be described, although it should be understood that the present invention is not limited to presses with a specific number of connection rods and connection screw assemblies for reciprocating slide 30, nor to a particular type of drive arrangement. Furthermore, the present invention is adaptable to shutheight adjustment mechanisms operating with bolster assembly 16.

Each of the connecting rods 38 of press 10 is at one end operatively connected for reciprocation to a crankshaft (not shown) and at the other end connected to a connection screw 34 by means of a wrist pin 40. In a conventional manner, wrist pin 40 is pivotally connection to connection screw 34.

Connection screw 34 is attached by bolts 59 to a piston 60 that slides within a cylinder bore 62 in slide 30. Cylinder bore 62 may be filled with pressurized or nonpressurized oil to assist in movement of piston 60 during calibration and operation. The cylinder bore 62 also permits piston 60 to slide downward, further into slide 30 to allow more adjustment distance on connection screw 34.

The lower end of connection screw 34 comprises a cylindrical portion 42 having threads 44 on the outer surface thereof interengaged with adjustment nut 46 having threads 48. Adjustment nut threads 48 threadably engages threaded portion 44 within nut 46. Top surface 47 and bottom surface 49 of adjustment nut 46 are engaged by portions of slide 30 as shown in FIG. 2. Adjustment nut 46 is also attached to worm gear 50 that is in intermeshing engagement with worm 52. Worm 52 is attached to a rotatable shaft 54 that is connected to a motor 160 (FIG. 6) for adjustment of shutheight. It will be appreciated that as shaft 54 is rotated, worm 52 will drive adjustment nut 46 through worm gear 50 about connection screw 34 thereby raising or lowering slide 30 on connection screw 34.

Figure 3:
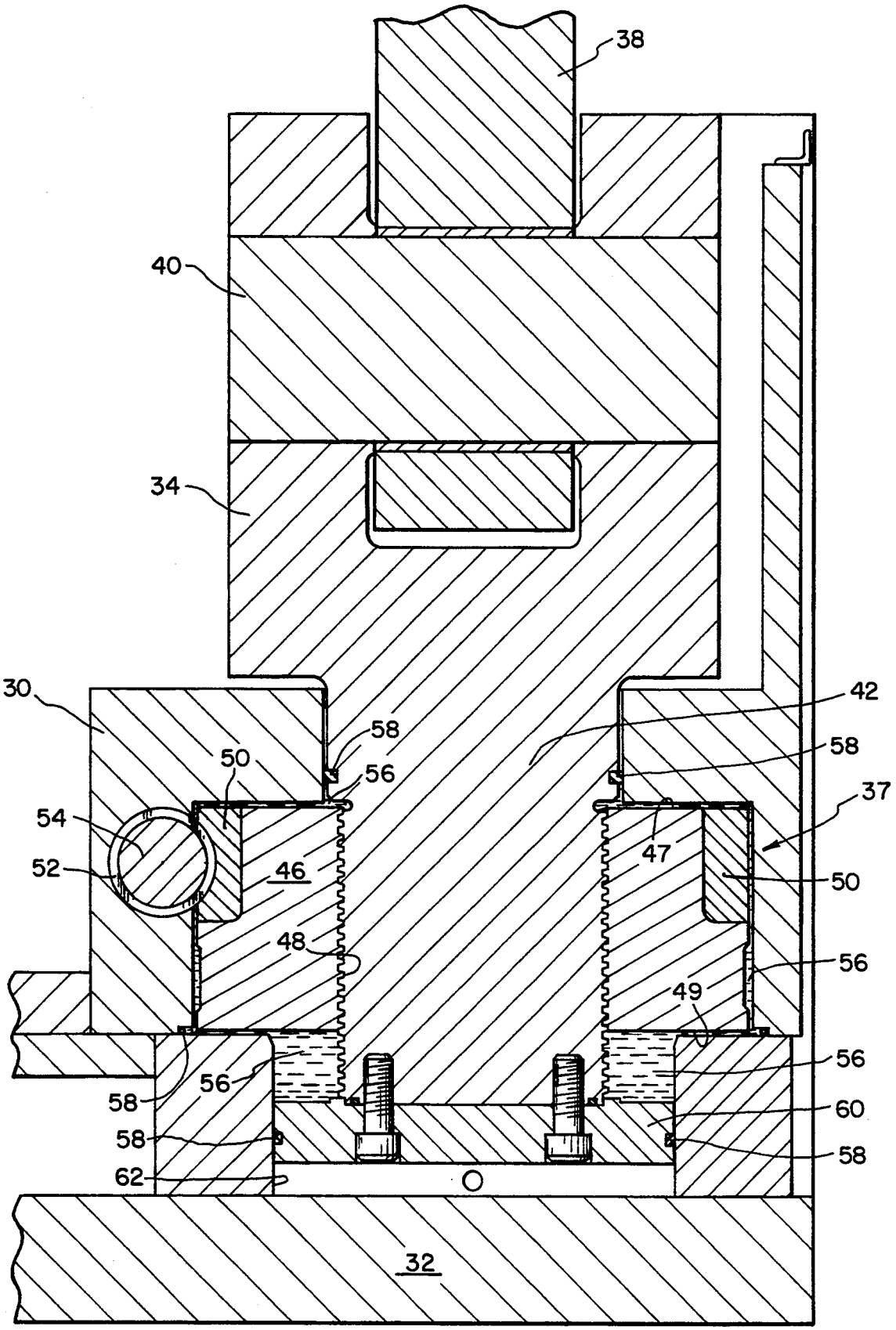
FIG. 3 is an enlarged fragmentary sectional view of the shutheight adjustment mechanism after it has been filled with oil.

As shown in FIG. 2, shutheight of the press may be adjusted by rotation of worm 52 which thereby rotates adjustment nut 46 about connection screw 34. Clearance spaces 56 are shown flooded with oil as in FIG. 3 according to the present invention. The embodiment of FIGS. 2 and 3 show seals 58 sealing oil within clearance spaces 56. The oil may be injected into clearance space 56 by means of a conventional oil pump 55 as shown in FIGS. 4 and 5. For proper operation of the shutheight adjustment mechanism and to maximize the benefits of the oil pressure squeeze film effect, clearance space 56 must be bled in a conventional manner to eliminate all trapped air. Alternatively, seals 58 may be eliminated and replaced with an oil recirculating means to replenish oil squeezed out during punching and snapthrough load applications.

In operation, the present invention is utilized in an embodiment shown in FIG. 3. During operation of press lid, a shutheight measuring means 21, such as an optical scanner or limit switch, will monitor the shutheight between slide 30 and bolster assembly 16. During operation of press 10, clearance spaces 56 within the adjustment mechanism 37 are flooded with lubricating oil and sealed with seals 58. This will trap oil within clearance spaces 56. When adjustment mechanism 37 is subjected to vertical press loads and slide inertial forces such as punching and snapthrough, the oil within clearances spaces 56 is squeezed. Since the oil has no where to flow or little time to flow a pressure film develops thus transmitting the load, through the adjustment mechanism 37 without high velocity impact. This mechanism is designed to support the above-mentioned forces on the oil film present on the top and bottom surface areas of adjustment nut 46 and on the flanks of the screw threads 44.

The oil squeeze-film on the lower side of adjustment nut 46 and the oil squeeze-film on the lower side of the thread flanks support the punching and upward inertial force loads. When the workpiece fractures in the die, the slide 30 attempts to rapidly accelerate downward i.e. snapthrough. The oil films on the top surface of the adjustment nut 47 and on the top surface of the thread flanks dampen this acceleration and support the snapthrough load.

The present invention, as shown in the previous embodiment, is not limited to shutheight adjustment mechanisms located within the slide or bolster portions of a press. Depending upon the size of press 10 and the required tonnage, different locations for shutheight adjustment are possible.

The feedback means for automatically controlling the shutheight will be discussed in relation to FIG. 6. However, it is understood and appreciated that alternative control arrangements may be utilized to control the set shutheight. The shutheight feedback means will be described in relation to the embodiment shown in FIGS. 1–3.

Figure 6:
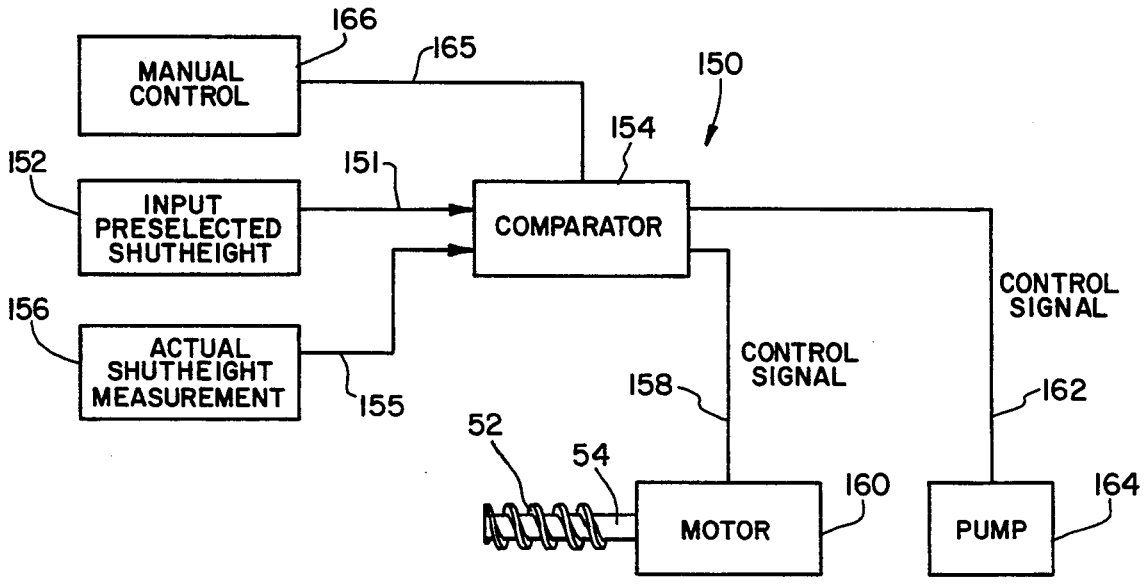
FIG. 6 is an exemplary diagrammatic arrangement of an automatic feedback means usable with the present invention.

Automatic control of shutheight is maintained by a control or feedback means 150 as shown in FIG. 6. Prior to operation, the press operator inputs a preselected shutheight 152 through line 151 into comparator 154. Feedback means 150 along with comparator 154 may comprise a microprocessor as known in the art. Comparator 154 receives input signals and provides output or control signals as a function of its inputs.

Shutheight measuring means 21 of FIG. 1 transmits an actual shutheight measurement 156 during press operation. Comparator 154 compares the difference between the preselected shutheight 152 and the actual shutheight 156 and forms a control signal on line 158 to a drive means, such as control motor 160 and another control signal on line 162 to an oil flow or oil pressurizing means such as oil pump 164. Pump 164 connects to clearance space 56 to pressurize or depressurize the oil therein or alternatively vary the flow of oil through the system. The results of the comparison between preselected shutheight 152 and the actual shutheight measurement 156 causes comparator 154 to vary the control signal on line 158 to control motor 160 to thereby control motor 160 forward or reverse. As shown in FIG. 6, control motor 160 is connected to rotatable shaft 54 and worm gear 52 to cause rotation of adjustment nut 46. As known in the art, control motor 160 is a high ratio drive unit capable of very precise movements to accurately rotate shaft 54. As shown in FIG. 6, comparator 154 may be overridden via a manual control circuit 166 along a line 165 for direct operator control of control motor 160 and pump 164.

Comparator 154, based on its inputs, may vary control signal on line 162 to pump 164 to vary the volume and pressure of oil pumped by pump 164. In this fashion, oil within clearance space 56 may be changed in pressure and flow during press operation and/or during shutheight adjustment. Although shutheight control and feedback means 150 has been described in relationship to the noted embodiment, feedback means 150 is adaptable to other embodiments also. Alternatively, instead of the comparator 154 being constructed from a microprocessor, a programmable logic controller may be utilized as is known in the art.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A press comprising:

a frame structure with a crown and a bed;

a slide guided by the frame structure for reciprocating movement in opposed relation to said bed;

a drive means attached to said frame structure for reciprocating said slide;

a bolster assembly mounted to said bed;

a shutheight adjustment mechanism arranged for adjustment-in-motion attached on the press to adjust the shutheight between said slide and said bolster, said mechanism having a male threaded member threadedly engaging a female threaded member, said male and female members having at least two portions that require a clearance space therebetween; and an injecting means for injecting a liquid within said clearance space whereby undamped free movement between said threaded members is reduced by the formation of a liquid squeeze-film within said clearance space during pressure loads between said portions.

2. The press of claim 1 in which said injecting means injects pressurized liquid into said clearance space.

3. The press of claim 2 in which said male threaded member is a connection screw and said female member is an adjustment nut.

4. The press of claim 1 in which said injecting means injects substantially non-pressured liquid into said clearance space.

5. The press of claim 1 in which said injecting means recirculates liquid through said clearance space.

6. The press of claim 1 in which said liquid completely fills said clearance space.

7. The press of claim 1 in which said liquid fills said clearance space.

8. The press of claim 1 in which said adjustment mechanism includes a plurality of seals that seal said liquid within said clearance space.

9. The press of claim 1 in which said clearance space will maintain a 0.0001 inch thick liquid film under action of the press.

10. The press of claim 1 in which said injection means changes the pressure of the liquid within said clearance space during press operation.

11. The press of claim 1 in which said injection means changes the pressure of the liquid within said clearance space during press operation when said shutheight adjustment drive mechanism actuates.

12. The press of claim 1 in which said injection means is a pump that is varied to change the pressure within said clearance space to establish a dynamic shutheight.

13. The press of claim 1 further including a control means for controlling said injecting means for injecting means varied in flow by said control means to establish a dynamic shutheight.

14. The press of claim 1 in which said shutheight adjustment mechanism includes a feedback means to measure the shutheight and automatically change the shutheight to a predetermined shutheight.

15. The press of claim 1 in which said shutheight adjustment mechanism includes a drive means and a worm connected to said drive means, said worm able to rotate one of said threaded members to change the press shutheight.

16. A press comprising:

a frame structure with a crown and a bed;

a slide guided by the frame structure for reciprocating movement in opposed relation to said bed;

a drive means attached to said frame structure for reciprocating said slide in opposed relation to said bed;

a bolster assembly mounted to said bed;

a shutheight adjustment mechanism arranged for adjustment-in-motion attached on said slide to adjust the shutheight between said slide and said bed, said mechanism having a male threaded member threadedly engaging a female threaded member, said male and female members having at least two portions that require a clearance space therebetween;

an injecting means for injecting a liquid within said clearance space whereby undamped free movement between said threaded members is reduced, by the formation of a liquid squeeze-film within said clearance space during pressure loads between said portions; and a control mechanism to vary the output of injected liquid by said injecting means, a measuring means to measure the shutheight of the press, said control mechanism varying the liquid injected by said injecting means based on said measured shutheight.

17. The press of claim 16 further comprising an adjustment drive means to rotate one of said threaded members relative to the other of said threaded members to change the press shutheight; and a control means to compare the measured shutheight to a desired shutheight and control actuation of said adjustment drive means.

18. A press comprising:

a frame structure with a crown and a bed;

a slide guided by the frame structure for reciprocating movement in opposed relation to said bed;

a device means attached to said frame structure for reciprocating said slide;

a bolster assembly mounted to said bed;

a shutheight adjustment mechanism arranged for adjustment-in-motion attached on said slide to adjust the shutheight therebetween, said mechanism having a male threaded member threadedly engaging a female threaded member, said male and female members having at least two portions that require a clearance space therebetween; and an injecting means for injecting a liquid within said clearance space whereby undamped free movement between said threaded members is reduced, by the formation of a liquid squeeze-film within said clearance space during pressure loads between said portions.

* * * * *